US008844654B2

(12) United States Patent
Boulet

(10) Patent No.: US 8,844,654 B2
(45) Date of Patent: Sep. 30, 2014

(54) INSTRUMENTED DRILL STRING ELEMENT

(75) Inventor: Jean Boulet, Paris (FR)

(73) Assignee: Vam Drilling France, Cosne Cours sur Loire (FR)

( * ) Notice: Subject to any disclaimer, the term of this patent is extended or adjusted under 35 U.S.C. 154(b) by 537 days.

(21) Appl. No.: 13/060,965

(22) PCT Filed: Sep. 22, 2009

(86) PCT No.: PCT/FR2009/001117

§ 371 (c)(1),
(2), (4) Date: Feb. 25, 2011

(87) PCT Pub. No.: WO2010/037919

PCT Pub. Date: Apr. 8, 2010

(65) Prior Publication Data

US 2011/0155470 A1 Jun. 30, 2011

(30) Foreign Application Priority Data

Sep. 30, 2008 (FR) ..... 08 05376

(51) Int. Cl.
*E21B 17/02* (2006.01)

(52) U.S. Cl.
CPC ..... *E21B 17/028* (2013.01)
USPC ..... 175/320; 166/65.1; 166/242.1; 340/855.1

(58) Field of Classification Search
USPC ..... 166/65.1, 242.1; 175/320; 340/855.1
See application file for complete search history.

(56) References Cited

U.S. PATENT DOCUMENTS 3,170,137 A * 2/1965 Brandt ..... 340/855.1
3,602,304 A * 8/1971 Mallinger et al. ..... 166/63
3,879,097 A * 4/1975 Oertle ..... 340/855.1
4,062,551 A * 12/1977 Base ..... 277/330
4,095,865 A * 6/1978 Denison et al. ..... 439/191
4,220,381 A 9/1980 Van der Graaf
4,788,544 A * 11/1988 Howard ..... 340/853.7

(Continued)

FOREIGN PATENT DOCUMENTS

EP 0 371 906 6/1990
WO WO 2010/037919 A1 4/2010
WO WO 2010/128351 A1 11/2010
WO WO 2011/010016 A2 1/2011

OTHER PUBLICATIONS

International Search Report issued Dec. 2, 2009 in PCT/FR09/001117 filed Sep. 22, 2009.
U.S. Appl. No. 13/821,462, filed Mar. 7, 2013, Chabas, et al.

(Continued)

*Primary Examiner* — Giovanna Wright
(74) *Attorney, Agent, or Firm* — Oblon, Spivak, McClelland, Maier & Neustadt, L.L.P.

(57) ABSTRACT

A drill string element including an elongate tubular body delimiting an interior surface longitudinally including at least one portion of revolution and including a first hole provided in the elongate tubular body. That first hole includes a first end opening at the portion of revolution, and in a vicinity of the first end a longitudinal axis intersecting the interior surface at an intersection location. The longitudinal axis, in projection into a first plane passing through the central axis of the portion of revolution and containing the intersection location, forms a first angle of a value that is not zero and in projection into a second plane tangential to the interior surface at the intersection location forms a second angle of a value that is not zero.

23 Claims, 9 Drawing Sheets

(56) References Cited

U.S. PATENT DOCUMENTS

| | | | | |
|---|---|---|---|---|
| 4,884,071 | A * | 11/1989 | Howard | 340/854.8 |
| 2005/0092499 | A1 | 5/2005 | Hall et al. | |
| 2005/0173128 | A1 | 8/2005 | Hall et al. | |
| 2010/0326738 | A1 | 12/2010 | Boulet | |

OTHER PUBLICATIONS

U.S. Appl. No. 13/822,136, filed Mar. 11, 2013, Chabas, et al.

* cited by examiner 1
2
3
5
7
8
9
10
11
12
13
14
15
16
17
18
19
21
23
25
ID1
ID2
102
27
31
32
34
35
36

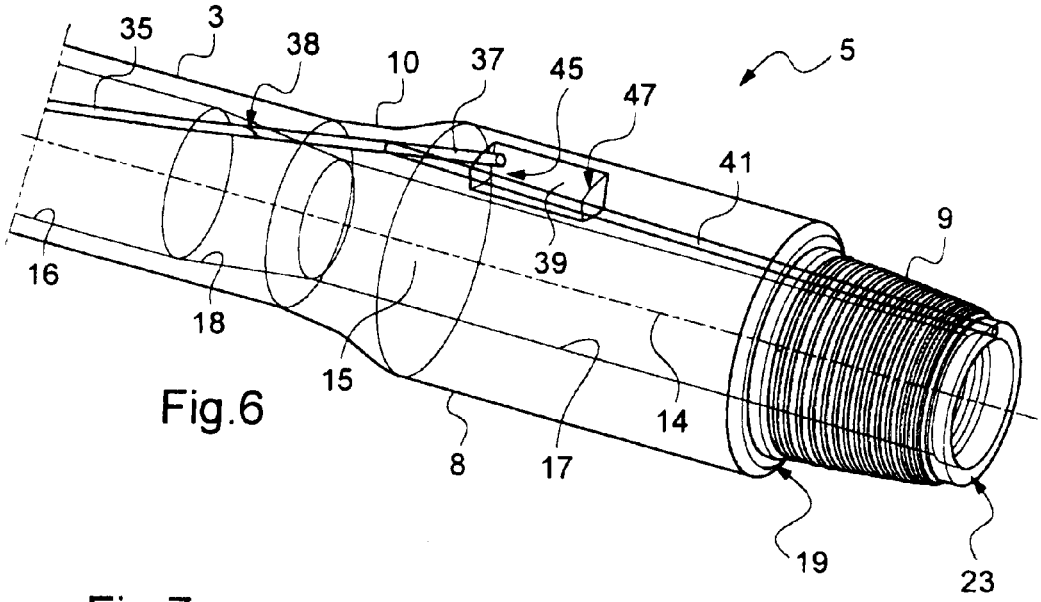
Fig.6
Fig.7
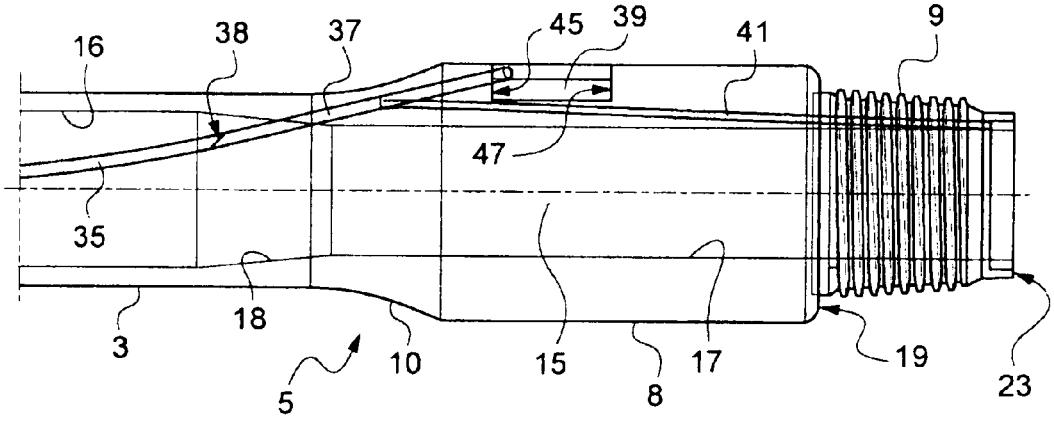
Fig.8
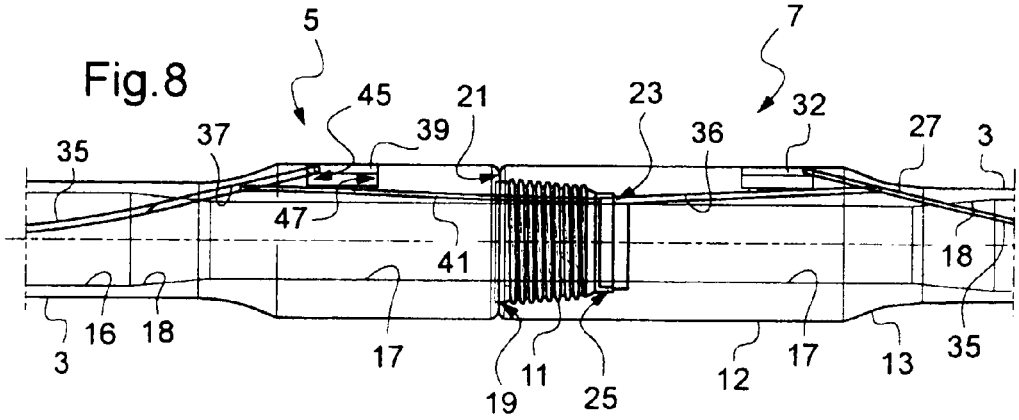

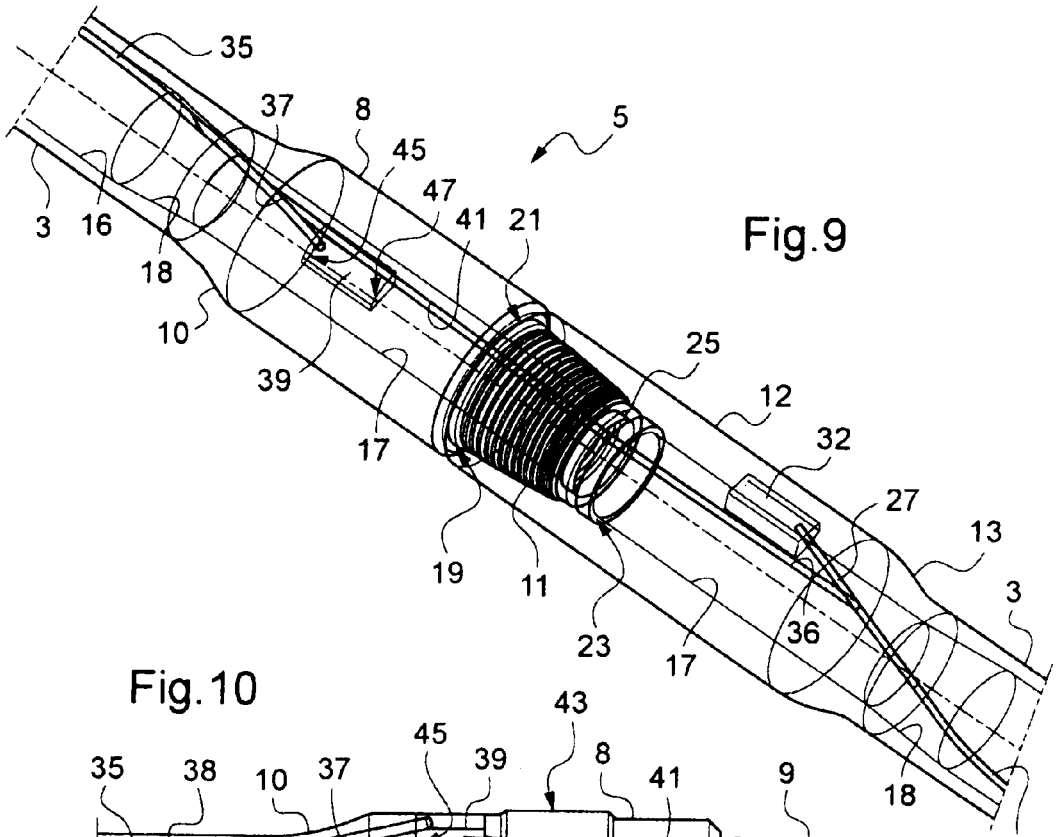
Fig.9
Fig.10
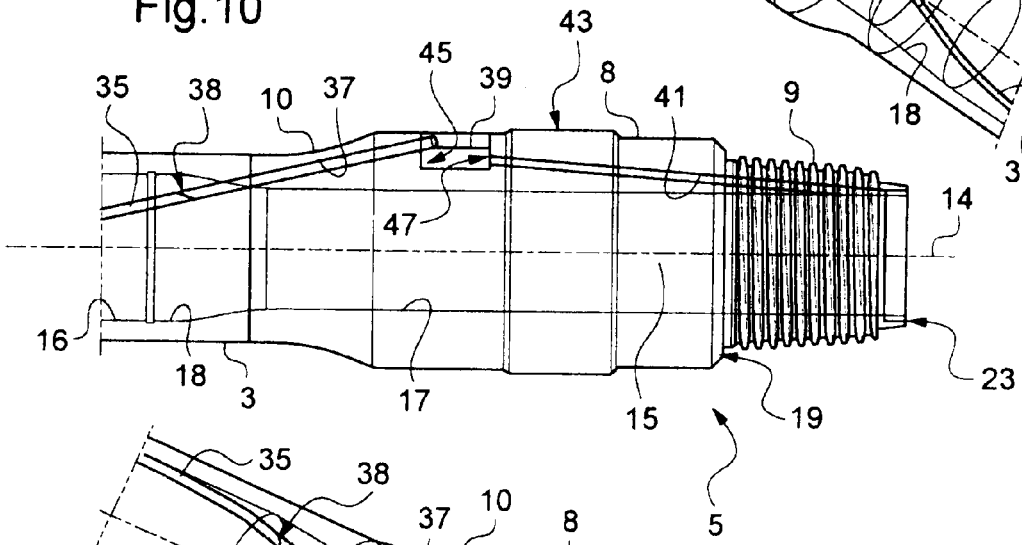
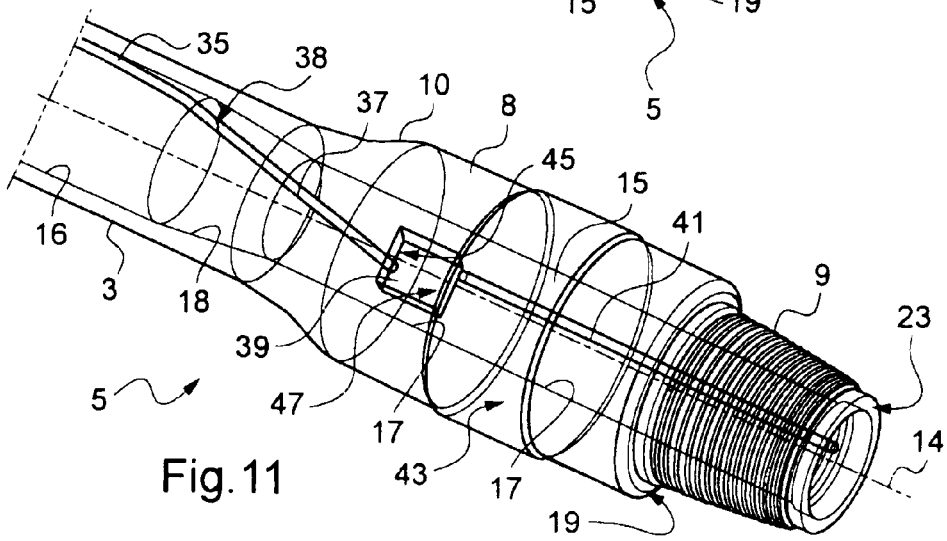
Fig.11

Fig.12
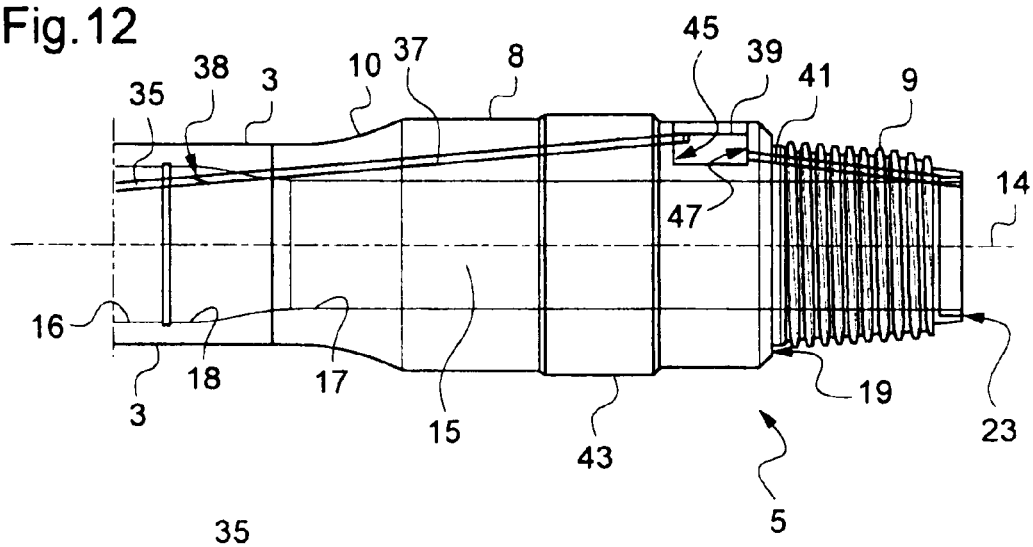
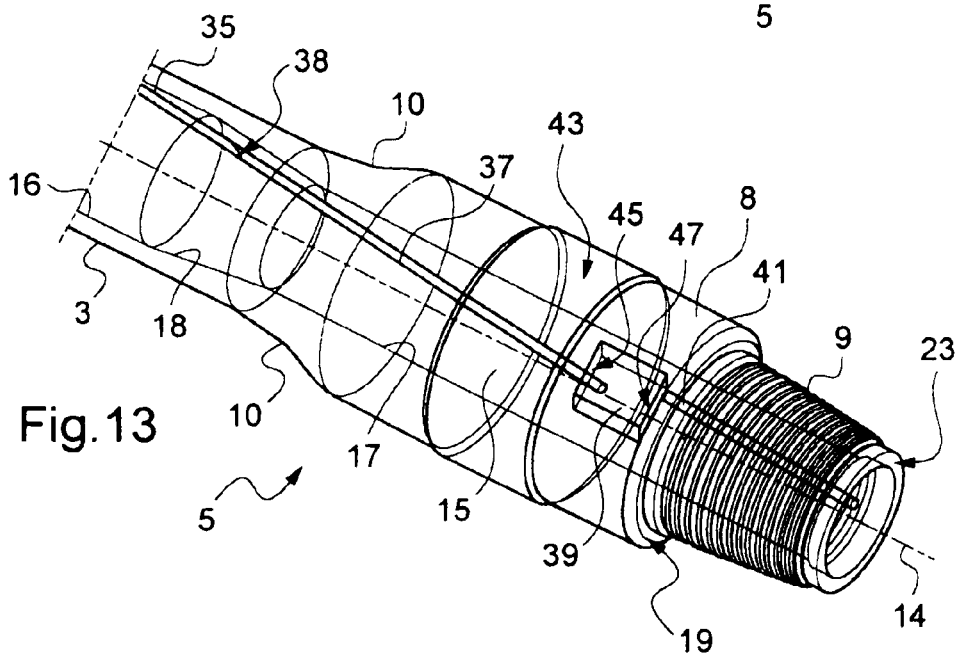
Fig.13
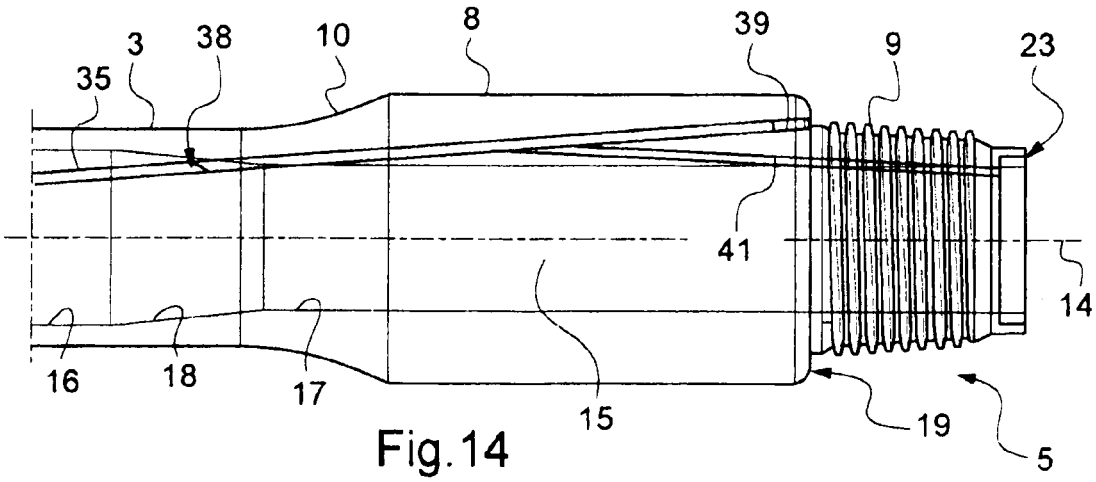
Fig.14

Fig.20
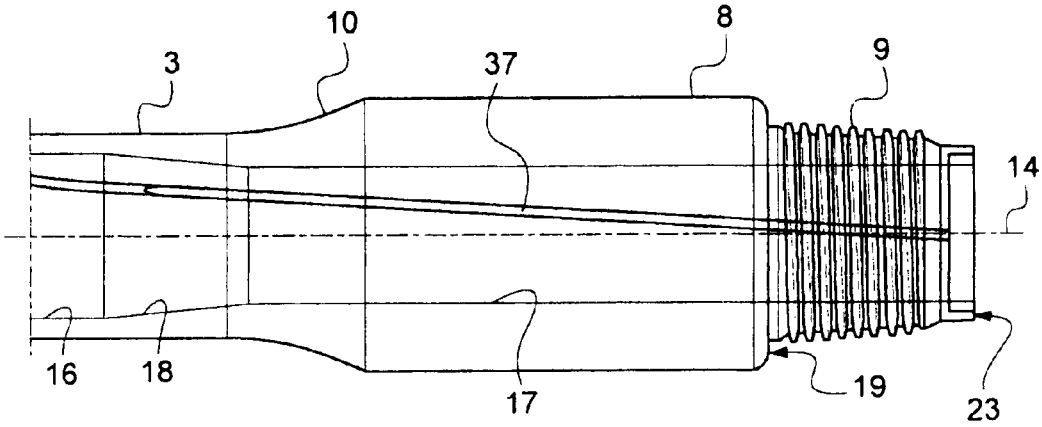
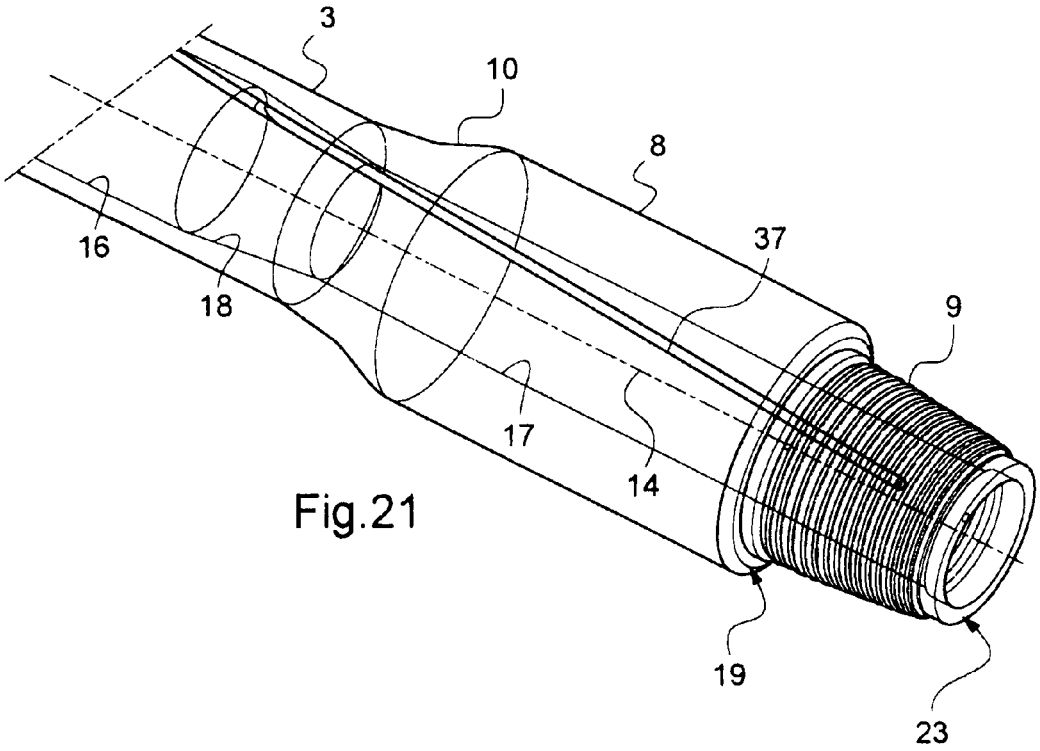
Fig.21

INSTRUMENTED DRILL STRING ELEMENT

BACKGROUND

The invention concerns a drill string element and a drill string composed of such elements.

Elements of that type are used in the field of drilling, in particular drilling for oil, to form a drill string which extends from the surface of the well to the bottom thereof.

Those elements comprise in particular the drill pipes, the heavy drill pipes and the drill collars. The specifications of the American Petroleum Institute (or 'API') define for example such elements.

In the course of the drilling operation new elements are connected in butting relationship to the elements already present in the drill string to extend the latter and to continue drilling to a greater depth.

At the present time measurement devices are disposed in the drill string to measure certain physical parameters relating to the drilling well, its environment or the drill string itself. Those devices which can be of varying types are in particular disposed in the proximity of the lower end of the drill string.

Memory systems can in some cases be associated with the measurement devices to record the measurement results.

Electrical energy is necessary for operation of the measurement devices and the memory systems.

Conventionally, electric batteries and/or turbine-type power generators are therefore added to the measurement devices. If necessary the turbine is caused to rotate by the flow of drilling fluid circulating through the elements of the drill string.

On the other hand it is appropriate for the measurement results attained to be communicated to the surface of the drilling well, without the whole of the drill string being pulled up to the surface.

To do that telemetry devices can be used, which are disposed in the well. For example electromagnetic devices operating at very low frequency can be used.

It is also possible to modulate the flow of the drilling fluid circulating in the interior of the drill string so that variations in the pressure and/or flow rate thereof can be detected at the surface.

The conventional devices both for the supply of electrical energy and for taking up the measurement data suffer from many different well-known disadvantages which involve in particular resistance to the loads encountered and the complexity in terms of connection of the different elements together along the drill string, and each time a fresh element is joined to the structure.

Finally a simple way of transporting electrical power and the measurement signals is to use electrically conductive elements of fixed-wire type. Different arrangements have thus been proposed for accommodating those conductor elements in the drill string elements.

Those arrangements however must meet certain demands such as for example reversible and easy connection of the elements together, resistance to the torsional, bending, compressive or tensile loads, unexpected shocks and vibrations or also erosion by the drilling fluid.

DESCRIPTION OF THE RELATED ART

US No 2006/0225926 discloses a drill string element provided with a cable.

The drill string element is in the form of a tube. The cable is sometimes accommodated in a passage provided in the wall of the tube and sometimes arranged in the interior of the tube against that wall. Electromagnetic coupling elements are disposed in the proximity of the longitudinal ends of the tube to transmit data from the cable to the cable of a similar tube adjacent in the drill string. The cable is protected by a tubular sheath applied firmly against the interior wall of the tube, for example by hydroforming. Such a sheath is found to be difficult and expensive to produce.

In US No 2005/0092499 and U.S. Pat. No. 4,095,865 a drill string element in the form of a tube is provided with a cable element disposed in the interior of a protective conduit. The protective conduit is in the form of a sheath disposed against the interior wall of the tube so as to extend along the tube in a helical configuration. The sheath is inserted into the interior of the tube by way of passages disposed at the ends of the tube and extending parallel to the central axis of the tube. That helical shape imparts very good resistance to the cable, in particular in relation to tensile and compressive loads.

Such an arrangement induces stress concentrations at the transition from the helicoidal arrangement to the rectilinear arrangement of the holes. In addition it is difficult to shape the sheath in a helical configuration.

BRIEF SUMMARY

The invention aims to improve that situation. For that purpose there is proposed a drill string element of the type comprising an elongate tubular body delimiting an interior surface longitudinally having at least one portion of revolution and having a first hole provided in the elongate tubular body and having a first end opening at said portion of revolution, the first hole having in the vicinity of said first end a longitudinal axis intersecting the interior surface at an intersection location, which is distinguished in that said longitudinal axis, in projection into a first plane passing through the central axis of the portion of revolution and containing the intersection location, forms a first angle of a value that is not zero and in projection into a second plane tangential to the interior surface at said intersection location forms a second angle of a value that is not zero.

By virtue of that particular arrangement of the drill string element, a sheath or a conduit or any other elongate flexible element can be introduced into the cylindrical cavity through the first hole. The sheath has imparted thereto a helical shape bearing against the wall of the longitudinal central bore just by virtue of the shape and position of the hole.

In addition the cable is of a continuous configuration between its portion accommodated in the through conduit and its adjacent portion extending freely in the central bore. The cable then affords better resistance to the drilling forces, in particular by virtue of eliminating the inflexion zone which existed at that location in the configurations in the state of the art.

There is also proposed a drill string formed by joining elements of the aforementioned type in butting relationship.

Optional features of the invention, which are complementary or alternative, are set forth hereinafter:

- Said elongate tubular body has at one at least of its longitudinal ends a junction portion intended to co-operate with another drill string element and comprising a substantially transversely disposed bearing surface, and an element at least of the group formed by said first hole and a first supplementary hole opens at the bearing surface.
- Said first hole opens in a peripheral recess in the elongate tubular body, which is open outwardly.
- Said first supplementary hole opens into said peripheral recess.

The first supplementary hole opens at the bearing surface and in said first hole.

Said first hole opens in the peripheral recess.

The junction portion further comprises a substantially transversely disposed supplementary bearing surface and the other element of said group opens at said supplementary bearing surface.

Said bearing surface is arranged at the free end of a junction portion of male type or in the form of an interior shoulder of a junction portion of female type.

The supplementary bearing surface is arranged in the form of an intermediate shoulder of the junction portion of male type or at the free end of the junction portion of female type.

The elongate tubular body has a second hole having a first end opening at the interior surface, said second hole having in the vicinity of said first end a longitudinal axis intersecting the interior surface at a second location.

The value of the second angle is selected in dependence on the longitudinal distance separating said first location from the second location.

The interior surface has at least one straight cylinder portion between the first location and the second location.

The straight cylinder portion extends substantially over the longitudinal distance separating the first location from the second location.

The second hole opens in a second portion of revolution and the longitudinal axis of the second hole, in projection in a third plane passing through the central axis of the second portion of revolution and containing said second location, forms a third angle of a value that is not zero and, in projection into a fourth plane tangential to the interior surface at said second location, forms a fourth angle of a value that is not zero.

The value of the fourth angle is close to the value of the second angle.

The first hole extends over practically the whole of its length in rectilinear relationship.

The element further comprises a flexible tubular element at least partially accommodated in said hole and extending over the interior surface while generally describing a helix.

Said helix involves an angle dependent on the value of the second angle.

The element further comprises an electrical connecting device accommodated in a wall thickness of said elongate tubular body.

The value of the second angle is between 5° and 40°.

BRIEF DESCRIPTION OF THE DRAWINGS

Other features and advantages of the invention will be apparent from the detailed description hereinafter and the drawings in which:

FIG. 6 shows a perspective view of an end portion of the drill pipe of FIG. 1, opposite to the end portion in FIGS. 3 and 4, FIG. 7 shows a front view of the end portion in FIG. 6, FIG. 8 shows a front view of the end portion of FIGS. 3 and 4 connected to the end portion of FIGS. 6 and 7, FIG. 9 is a perspective view similar to FIG. 8, FIG. 10 is a front view of a first variant of the end portion of FIGS. 6 and 7, FIG. 11 is a perspective view similar to FIG. 10, FIG. 12 is a front view of a second variant of the end portion of FIGS. 6 and 7, FIG. 13 is a perspective view similar to FIG. 12, FIG. 14 is a front view of a third variant of the end portion of FIGS. 6 and 7, FIG. 20 is a front view of a fourth variant of the end portion of FIGS. 6 and 7, FIG. 21 is a perspective view similar to FIG. 10.

The accompanying drawings can serve not only to complete the invention but also to contribute to defining it if appropriate.

DETAILED DESCRIPTION

Figures 1, 2, 3:
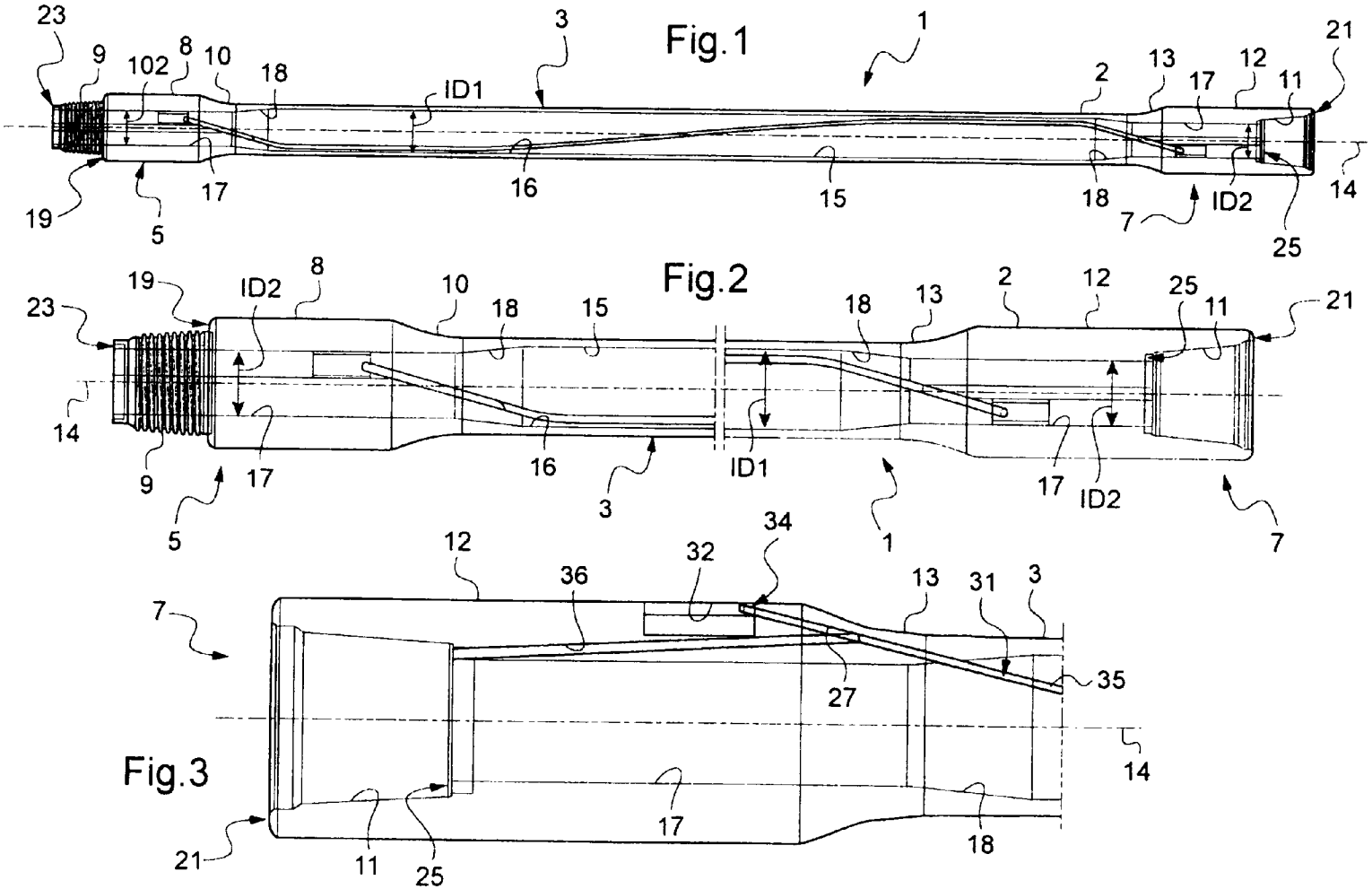
FIG. 1 shows a front view of a drill pipe according to the invention.
FIG. 2 shows a front view on an enlarged scale and after truncation of the drill pipe of FIG. 1.
FIG. 3 shows a front view of an end portion of the drill pipe in FIG. 1.

FIGS. 1 and 2 illustrate a drill string element in the form of a drill pipe 1. The drill pipe comprises primarily an elongate tube 2 having an elongate central portion 3.

A first junction portion 5 and a second junction portion 7 are arranged at the opposite ends of that central portion 3.

The first junction portion 5 and the second junction portion 7 are shaped in a corresponding configuration. That means that the first junction portion 5 and the second junction portion 7 are capable of respectively co-operating with a second junction portion 7 and a first junction portion 5 of similar elongate tubes to connect the drill pipes together.

The first junction portion 5 is here of the 'male' type while the second junction portion 7 is of 'female' type, those portions being shaped in complementary relationship. That means that the male junction portion 5 can be fitted into a female junction portion 7 of a similar elongate tube to produce an assembly of drill pipes 1.

A drill string can be produced by connecting the elongate tubes of a plurality of drill pipes by co-operation of the first junction portions 5 and the second junction portions 7.

Here that connection of the elongate tubes 2 is effected by the co-operation in respect of shape of male junction portions 5 and female junction portions 7.

The male junction portion 5 comprises a main sub-portion 8 disposed between a fixing sub-portion 9 terminating the elongate tube 2, and a transitional sub-portion 10 connecting the main sub-portion 8 to the central portion 3.

The fixing sub-portion 9 projects axially from the intermediate sub-portion 8.

The fixing sub-portion 9 is externally shaped so that it can be received in a fixing bore 11 provided internally in the second junction portion 7 of a drill pipe 1 and opened to the end of the corresponding drill pipe 2.

The second junction portion 7 comprises a main sub-portion 12 terminating the elongate tube 2 and a transitional sub-portion 13 connecting that main sub-portion 12 to the central portion 3.

Here the fixing sub-portion 9 is of a tubular frustoconical, externally screwthreaded shape while the fixing bore 11 is of a complementary conical screwthreaded shape.

The elongate tube 2 is in the form of a portion of revolution having a straight longitudinal central axis 14.

The first junction portion 5 and the second junction portion 7 are preferably in the form of mechanical parts which are separate and then fitted to the elongate central portion 3, for example by means of a friction welding operation.

The first junction portion 5 and the second junction portion 7 are often referred to by the term 'tool-joint'.

In a variant the elongate tube 2 may be made in one piece.

The elongate tube 2 is of an annular cross-section, the internal and external diameters of which vary over the length of the elongate tube 2 to form and delimit different portions of the tube 2. The thickness of the wall of the elongate tube 2 may also vary over the length thereof.

The elongate tube 2 has a longitudinal central bore 15 passing through the elongate tube 2 from one end to the other. In other words the central bore 15 passes through the central portion 3, the first junction portion 5 and the second junction portion 7. In particular that longitudinal central bore 15 opens into the fixing bore 11 and passes through the fixing sub-portion 9.

In FIGS. 1 and 2 the longitudinal central bore 15 is of a circular section of a diameter which varies over the length of the elongate tube 2, so as to form and delimit different portions of that central bore 15.

In particular the central bore 15 here has a central portion 16 of a first diameter value ID1, disposed between two junction portions 17 of a second diameter value ID2 that is less than the value ID1. On each occasion a transitional portion 18 connects the central portion 16 to a junction portion 17.

Here, a junction portion 17 of the bore 15 is each time provided in each of the junction portions of the first junction portion 5 and the second junction portion 7.

In addition each of the first junction portion 5 and the second junction portion 7 is of an outside diameter which is substantially larger than the outside diameter of the central portion 3.

In other words the elongate tube 2 is of a wall thickness substantially greater at the first and second junction portions 5 and 7 than in the central portion 3. That makes it possible in particular to transmit a sufficient tightening torque to ensure connection of two adjacent pipes in the drill string, in spite of the pipes being caused to rotate when they are lowered into the drilling well.

The first junction portion 5 has a first bearing surface 19 while the second junction portion 7 has a first bearing surface 21, the first bearing surfaces 19 and 21 being arranged in complementary relationship. That means that surface support can be implemented by the co-operation of the first bearing surfaces 19 and 21 of similar elongate tubes 2.

Here the first bearing surfaces 19 and 21 are in the form of flat, generally annular faces disposed substantially perpendicularly to the central axis 14.

The first bearing surface 19 of the first junction portion 5 is afforded by an abrupt variation in outside diameter between the main sub-portion 8 and the fixing sub-portion 9. In other words the first bearing surface 19 is produced in the form of a shoulder.

The first bearing surface 21 of the second junction portion 7 is formed by an end face of the elongate tube 2, at which the fixing bore 11 opens.

The length of the fixing sub-portion 9 and that of the fixing bore 11 are such that mutual planar support is afforded between the first bearing surfaces 19 and 21 when two similar drill pipes 1 are connected together.

Here, the first junction portion 5 further has a second bearing surface 23 or supplementary bearing surface while the second junction portion 7 further has a second bearing surface 25 or supplementary bearing surface, the second bearing surfaces 23 and 25 being shaped in complementary relationship.

The second bearing surface 23 is arranged at the free end of the fixing portion 9. The second bearing surface 25 is arranged at the bottom of the fixing bore 11.

The second bearing surfaces 23 and 25 are arranged in the form of flat, generally annular faces disposed substantially perpendicularly to the longitudinal central axis 14.

The second bearing surface 23 of the first junction portion 5 is formed by an end face of the fixing sub-portion 9, at which the central bore 15 opens.

The second bearing surface 25 of the second junction portion 7 is afforded by an abrupt variation in diameter between the bottom of the fixing sub-portion 11 and the central bore 15.

The length of the fixing portion 9 and that of the fixing bore 11 are such that mutual planar support is afforded between the second bearing surfaces 23 and 25 when two drill pipes 1 are mutually connected.

The connection between two drill pipes 1 involves two planar supports or shoulders between a first junction portion 5 and a second junction portion 7 respectively afforded by the first bearing surfaces 19 and 21 and the second bearing surfaces 23 and 25 coming into contact. Those shoulders permit the drill pipes to be connected under a given makeup torque and with sealing integrity in respect of the connection for the drilling fluid.

Such an arrangement can be referred to as "double abutment" or "double shoulder": the first bearing surfaces 19 and 21 constitute an external abutment while the second bearing surfaces 23 and 25 or supplementary bearing surfaces constitute an internal abutment. Referring to the bearing surfaces as 'first', 'second' or 'supplementary' is independent of the distribution of the forces between those surfaces when the drill pipes 1 are connected to each other with tightening thereof: the supplementary bearing surfaces 23 and 25 may be found to be the main bearing surfaces, in the sense that the contact pressure there is higher than the contact pressure between the first bearing surfaces 19 and 21.

The shoulders of one and/or the other of the internal and external abutments make it possible to accommodate devices for the transmission of electrical signals from one drill pipe to another by way of magnetic coupling.

Figure 4:
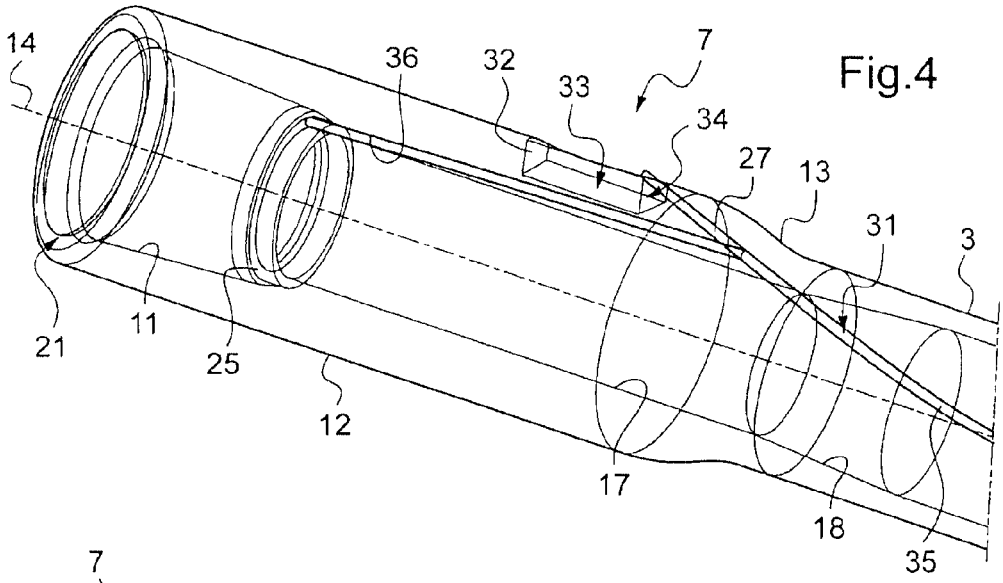
FIG. 4 shows a perspective view of the end portion of FIG. 3, FIGS. 5A and 5B are simplified views showing the end portion of FIG. 3, respectively as a longitudinal section and as a view from above in projection on to a plane of projection tangential to a bore portion of the end portion and passing through a particular point of that bore portion.

FIGS. 3 and 4 illustrate the end of the elongate tube 2 corresponding to the second junction portion 7.

In that second junction portion 7 the elongate tube has a first hole 27 provided in the thickness of the wall of the elongate tube 2 and opening at the central bore 15, here at the corresponding transitional portion 18.

The first hole 27 is here provided at the level of the main sub-portion 12 and the transitional sub-portion 13.

That first hole 27 extends here in a straight configuration along a longitudinal axis 29 which is not shown in FIGS. 3 and 4. The longitudinal axis 29 intersects the central bore 15 at a first location 31.

At that first location 31 the central bore 15 involves a central plane P1 containing the longitudinal central axis 14 and a tangential plane P2 which is not shown in FIGS. 3 and 4. Here, the tangential plane P2 is tangential to the transitional portion 18.

At the level of the second junction portion 7 the elongate tube 2 has a peripheral recess 32 which is provided in the thickness of its wall and into which the first hole 27 opens, at its end opposite to the bore 15.

The peripheral recess 32 is open to the exterior of the elongate tube 2, here to the external periphery of the junction portion 7.

The peripheral recess 32 involves a general configuration of a rectangular parallelepiped. A base face 33 of that parallelepiped is generally parallel to the longitudinal central axis 14. That base face 33 extends in respect of its length in parallel relationship with that central axis 14. The first hole 27 opens at a small-side face 34, at a longitudinal end of the peripheral recess 32.

A part of a cable protective sheath 35 or conduit introduced from the peripheral recess 32 is accommodated in the first hole 27. The protective sheath 35 is of a flexibility which, in regard to its part which is not in the first hole 27, permits it to extend in the interior of the space defined by the longitudinal central bore 15.

In the second junction portion 7 the elongate tube 2 also has a first diversionary hole 36 or first supplementary hole which is provided in the thickness of the wall and which opens in the first hole 27.

At its end opposite to the first hole 27 the first diversionary hole 36 opens at the second bearing surface 25 of the second junction portion 7. The first diversionary hole 36 here has a single straight portion.

The first diversionary hole 36 can be used to pass one or more cables connected to an energy/data transmission element disposed in the proximity of the second bearing surface 25, into the interior of the protective sheath 35 and from there to pass through the whole of the elongate tube 2. Typically that transmission element comprises a magnetic coil from which at least one transmission cable extends.

In other words the first diversionary hole 36 provides a junction between the second bearing surface 25 of the second junction portion 7 and the first hole 27. The second junction portion 7 may comprise an annular housing for a signal transmission device, for example of the type described in U.S. Pat. Nos. 6,670,880 and 6,641,434.

The protective sheath 35 can be partially cut off transversely to simplify the operation of introducing the cables, or again it may be provided with a dedicated orifice.

The peripheral recess 32 may accommodate a casing (not shown) used for pre-stressing the protective sheath 35.

The protective sheath 35 may accommodate additional cables or any other sufficiently fine and flexible element which are introduced from the recess 32. The latter may then receive one or more connecting cases (not shown) for those additional cables.

The peripheral recess 32 may also or alternatively accommodate electronic components of different types such as signal amplifiers, sensors, transducers, filters and the like.

Figure 24:
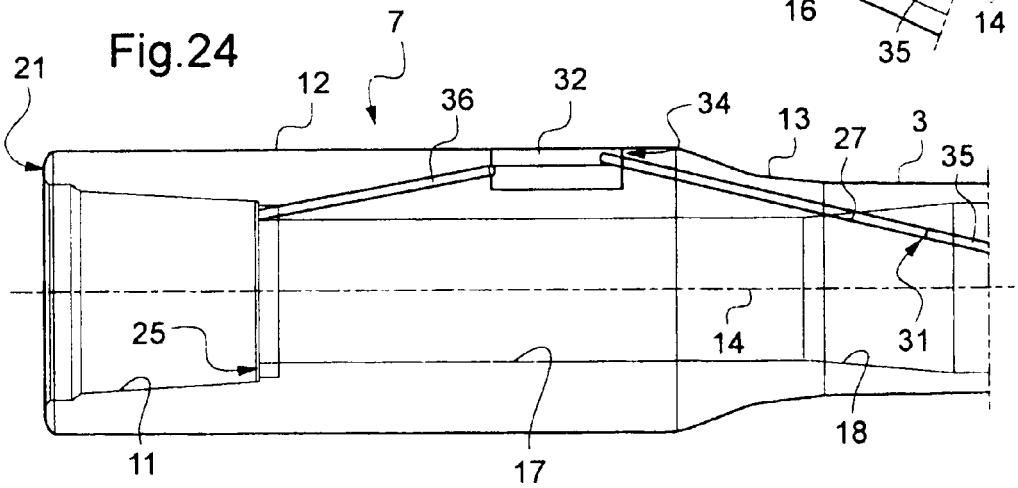
FIG. 24 is a view similar to FIG. 3 for a variant of the drill pipe 1.

In a variant illustrated in FIG. 24 the first diversionary hole 36 opens into the peripheral recess 32 on the one hand and at the second bearing surface 25 of the second junction portion 7 on the other hand.

Figure 5A:
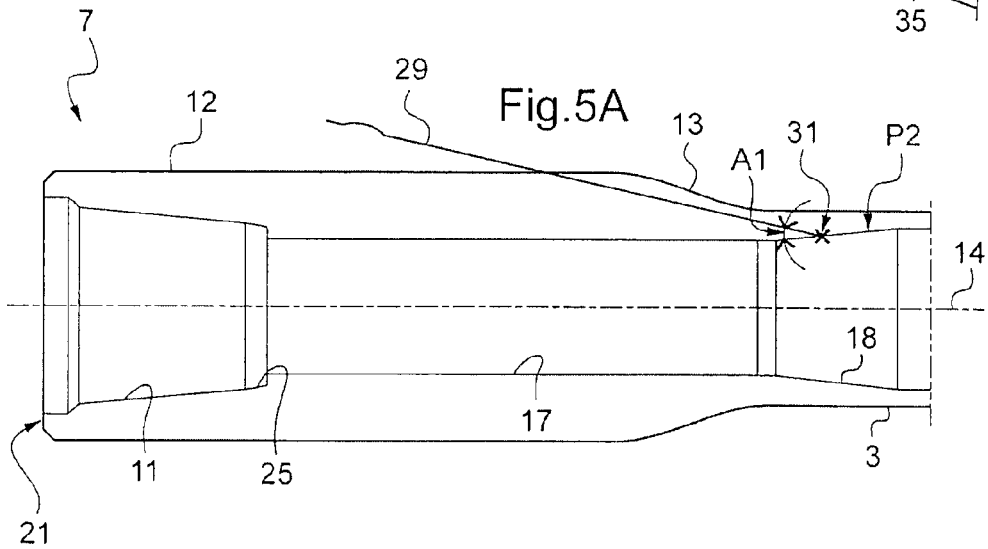
Figure 5B:
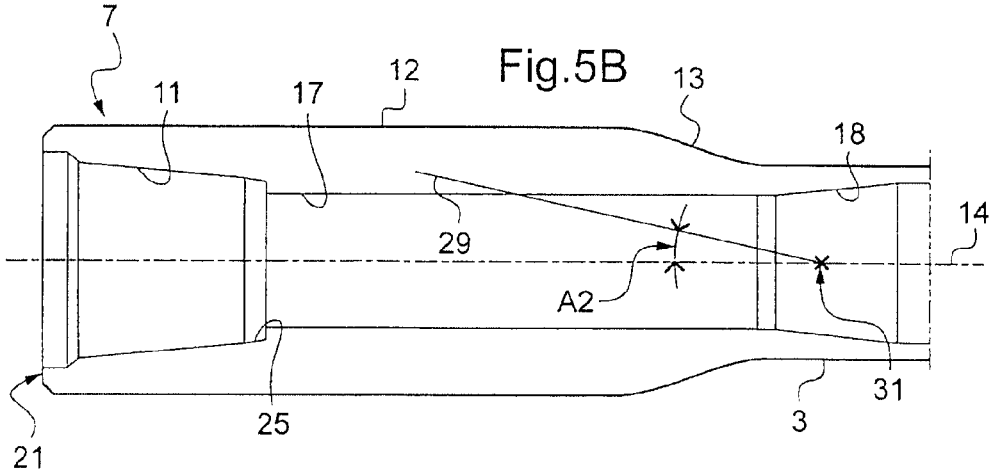

FIG. 5A diagrammatically shows the elongate tube 2 in section along the central plane P1 while FIG. 5B diagrammatically shows the elongate tube 2 seen from above in a plane perpendicular to the central plane P1.

In the plane in FIG. 5A the longitudinal axis 29 of the first hole 27 forms a first angle A1 or penetration angle with the tangential plane P2. In other words the projection of the longitudinal axis 29 of the first hole 27 into the central plane P1 forms an angle that is not zero with the projection of the central plane P2 into that plane.

In the plane in FIG. 5B the longitudinal axis 29 of the first hole 27 forms a second angle A2 or bias angle with the longitudinal central axis 14. In other words the projection of the longitudinal axis 29 of the first hole 27 into the plane P2 forms an angle that is not zero and is of a selected value, with the projection into that plane of the longitudinal central axis 14.

That particular configuration of the first hole 27 ensures a helical shape and constant support against the longitudinal central bore 15, for the protective sheath 35. That shaping effect occurs practically naturally by virtue of the above-described particular configuration.

The helicoidal shaping affords good resistance to the flexural (bending) forces which can occur at the pipe 1 in the course of drilling or when pulling it up: the tensile forces on the parts in extrados relationship are compensated by the compressive forces on the parts in intrados relationship.

Furthermore that helical shaping avoids buckling of the protective sheath 35 under compressive forces, which buckling can cause the protective sheath 35 to bulge in the longitudinal central bore 15.

The first hole 27 offers a simple way of applying that helicoidal shape to the protective sheath 35.

Thanks to that configuration of the first hole 27, the drill pipe 1 surpasses the drill pipes in the state of the art, in which a flexible protective element is introduced by way of a hole extending in coaxial relationship with the pipe. In a pipe in the state of the art, the flexible element in question is subjected to an axial compressive force which is very substantial in order for it to adopt a helical shape. The flexible element is also subjected to an abrupt change in direction at the exit opening of the coaxial hole, and that change in direction generates harmful stress concentrations leading to fatigue ruptures of the flexible element in operation thereof.

The use of a pre-stressing casing accommodated for example in the recess 32 ensures that the protective sheath 35 remains pressed firmly in contact against the central bore 15, including when the elongate tube 2 is subjected to the drilling loads, in particular bending. In other words an axial compressive force is advantageously exerted at the ends of the conduit so as to shorten its axial bulk.

The penetration angle A1 is not zero so that the first hole 27 can penetrate into the longitudinal central bore 15. However the angle A1 is selected to be as small as possible for good continuity between the part of the protective sheath 35 that is accommodated in the first hole 27 and the part extending over the longitudinal central bore 15. An excessively substantial break or inflexion constitutes a point of embrittlement for the protective sheath 15. Here, the transitional portion 18 is of a slightly frustoconical configuration diverging towards the centre of the drill pipe 1, which assists with penetration of the first hole 27. The transitional portion 18 may involve an apex half-angle of for example 5 to 10 degrees.

The penetration angle A1 can assume values of between 2 and 20 degrees for example.

The bias angle A2 is close to the angle of the helix described by the protective sheath 35 over the longitudinal central bore 15, in particular in its central portion 16. The value of that bias angle A2 is related to the pitch of the helix and the length of the elongate tube 2. That value of the bias angle A2 can be determined in such a way that the protective sheath describes a particular desired helical configuration. That value may also be arbitrarily selected from a range of suitable values. That is the case in particular for applications where it is possible to be satisfied with a generally helical shape, without requiring a particular form of helix.

The smaller the value of the bias angle A2, the greater the reduction in the pressure drops in the space defined by the longitudinal central bore 15.

The greater the value of the bias angle A2 the more the protective sheath 35 is capable of absorbing the axial tensile and compressive forces acting on the drill pipe 1.

The choice of ranges of values, or a particular value, in respect of the bias angle A2 results from a compromise which can depend on the different applications envisaged.

At the present time values of the bias angle A2 of between 2° and 40° are satisfactory and are therefore deemed to be preferable. That range of values is interpreted apart from machining tolerances.

In that configuration the first hole 27 is practically disposed as an immediate prolongation of the helicoidal shape adopted by the protective sheath 35. Hence that flexible element involves practically no inflection, in projection into the tangential plane P1, between its part accommodated in the longitudinal central bore 15 and its portion accommodated in the first hole 27. The residual inflexion between those parts of the protective sheath 35 is practically limited to the penetration angle A1, the bias angle A2 corresponding to the helix angle.

Any rupture of the protective sheath 35 is thus avoided or is at least made highly improbable, in particular in the case of the drill pipe 1 operating in a rotary flexural mode. In other words the particular configuration of the first hole 27 makes the protective sheath 35 less subject to rupture.

Here the first hole 27 is used for the purposes of shaping the protective sheath 35 but any other sufficiently flexible and long element introduced into the longitudinal central bore 15 through that first hole 27 would naturally extend therein along that generally helicoidal configuration by bearing against the peripheral surface of the bore 15.

In other words the particular configuration of the through conduit 27 makes it possible to easily shape any sufficiently flexible element such as cables, in a helical configuration.

In this embodiment the first hole 27 connects the space defined by the longitudinal central bore 15 to the external periphery of the elongate tube 2. Introduction of the protective sheath 35 is facilitated thereby, in particular in relation to an introduction hole which would extend in coaxial relationship with the elongate tube 2.

If appropriate the location at which the first hole 27 and the first diversionary hole 36 join may be so selected that the longitudinal axis of the latter forms, in particular in the transverse central plane P1, a reduced angle to facilitate introducing a cable into the protective sheath 35.

The first hole 27 and the first diversionary hole 36 can be produced by different processes, for example by 'gun drilling'.

FIGS. 6 and 7 show the first junction portion 5 of the elongate tube 2.

In that first junction portion 5 the elongate tube 2 has a second hole 37 disposed in the thickness of the wall of the elongate tube 2 and opening to the central bore 15, here the corresponding transitional portion 18.

The second hole 37 is here provided at the level of the main sub-portion 8 and the transitional sub-portion 10 of the first junction portion 5.

Here, that second hole 37 extends straight, along a longitudinal axis (not shown in FIGS. 6 and 7).

The longitudinal axis of the second hole 37 intersects the central bore 15 at a second location 38.

The second hole 37 is arranged in a similar fashion to the first hole 27, namely:

- at the second location 38 the central bore 15 involves a central plane P3 containing the longitudinal central axis 14 and a tangential plane P4 (not shown in FIGS. 6 and 7);
- in the central plane P3 the projection of the central axis of the second hole 37 forms a penetration angle that is not zero, with the projection of the tangential plane P4; and
- in the tangential plane P4 the projection of the central axis of the second hole 37 and the projection of the longitudinal central axis 14 form an angle that is not zero, of a selected value, in relation to the helical shape adopted by the protective sheath 35 over the longitudinal central bore 15.

The value of the angle of penetration of the central axis of the second hole 37 can be close to the value of the penetration angle A1 of the central axis 29 of the first hole 27, in particular to simplify the machining ranges. Those angle values can also differ from each other in some cases, in particular when the transitional portions 18 of the first junction portion 5 and the second junction portion 7 are of different conicity values.

The value of the bias angle of the central axis of the second hole 37 is advantageously close to the value of the bias angle A2 of the central axis 29 of the first hole 27, in particular to ensure continuity in the shape adopted by the protective sheath 35 between its part bearing against the longitudinal central bore 15 and its part accommodated in the central hole 37.

The relative angular position of the first location 27 and the second location 38, in transverse projection plane with respect to the elongate tube 2, can be determined in dependence on the helicoidal shape desired for the protective sheath 35, and the length of the longitudinal central bore.

In most of the applications, the length of the elongate tube 2 is such that said relative angular position of the first location 27 and the second location 37 has only very little influence on the shape adopted by the protective sheath 35 and can be selected in practically arbitrary fashion. In other words the choice of the value of the bias angle A2, in combination with the distance longitudinally separating the first location 27 and the second location 37, determines the number of turns described by the protective sheath 35; that number of turns is influenced by the relative angular position of the first location 27 and the second location 37, at a maximum, only for one turn. The greater the number of turns, the more the influence of that relative angular position is negligible.

At the first junction portion 5 the elongate tube 2 has a second peripheral recess 39 which is provided in the thickness of its wall and into which the second hole 27 opens, at its end opposite to the bore 15.

The second peripheral recess 39 is open to the exterior of the elongate tube 2, here the external periphery of the first junction portion 5.

Here the second peripheral recess 39 is of a similar shape to the peripheral recess 33 of the second junction portion 7.

In the first junction portion 5 the elongate tube 2 also has a second diversionary hole 41, or second supplementary hole, provided in the thickness of the wall and opening into the second hole 37.

At its end opposite to the second hole 37 the second diversionary hole 41 opens at the second bearing surface 23 of the first junction portion 5. For the remainder, the second diversionary hole 41 is similar to the first diversionary hole 36.

The second diversionary hole 41 can be used to pass one or more cables connected to an energy/data transmission element, similar to the element accommodated in the vicinity of the second bearing surface 25 of the second junction portion 7, accommodated in the proximity of the second bearing surface 23, into the interior of the protective sheath 35.

In other words the second diversionary hole 41 provides a junction between the second bearing surface 23 of the first junction portion 5 and the second hole 37.

FIGS. 8 and 9 show a first junction portion 5 of a first drill pipe 1 connected to a second junction portion 7 of a second drill pipe 1.

Transmission of data and/or energy between those adjacent drill pipes 1 being effected by way of magnetic coils disposed in mutually facing relationship, typically in annular grooves in the first bearing surfaces 19 and 21, no electric cable has to be passed from one pipe to the other. The relative angular position of the exit ends of the first diversionary hole 36 and the second diversionary hole 41 in a plane of projection transverse in relation to the elongate tube 2 can be practically immaterial.

In other words, those ends are not necessarily in mutually facing relationship when the first and second pipes 1 are assembled. Such a relative arrangement however is not to be excluded, and it is possible for the situation to be such that said mouth ends are in mutually facing relationship as shown in FIGS. 8 and 9.

FIGS. 10 and 11 show a first variant of the first junction portion 5 for the drill pipe 1. Functional elements identical to those of the foregoing Figures are denoted by identical references.

At the main sub-portion 8 of the first junction portion 5 the elongate tube 2 here has an intermediate portion 43 of an outside diameter larger than the remainder of the main sub-portion 8. In other words the elongate tube 2 has a larger wall thickness at the location of the intermediate portion 43, than in the remainder of the main sub-portion 8.

The intermediate portion 43 and the zones adjacent thereto can be shaped in the manner described in the French patent application filed under the No. 08/00942 which is not published at the date of filing of the present invention.

The second peripheral recess 39 is provided at the location of the part of the main sub-portion 8, that is separated from the fixing sub-portion 9 by the central portion 43. The second hole 37 opens into that peripheral recess 39 at a first small transverse face 45 of the recess.

In this embodiment the second diversionary hole 41 also opens into the second peripheral recess 39, here at a second small transverse face 47 opposite to the first small transverse face 45. The second diversionary hole 41 does not open directly into the first hole 37.

An electric cable accommodated in the second diversionary hole 41 can here be introduced into the protective sheath 35 at the level of the second peripheral recess 39. In a variant, that second peripheral recess 39 can accommodate an electrical junction arrangement (not shown) so that the cable accommodated in the second diversionary hole 41 and an additional cable accommodated in the protective sheath 35 are connected together by way of that arrangement. That may avoid introducing a cable in the interior of the protective sheath 35 once the latter has been set in place.

FIGS. 12 and 13 show a second variant of the first junction portion 5 of the elongate tube 2.

This second variant differs from the first one in that the second peripheral recess 39 is here provided at the level of the main sub-portion 8 of the first junction portion 5, close to the connecting sub-portion 9.

Figure 15:
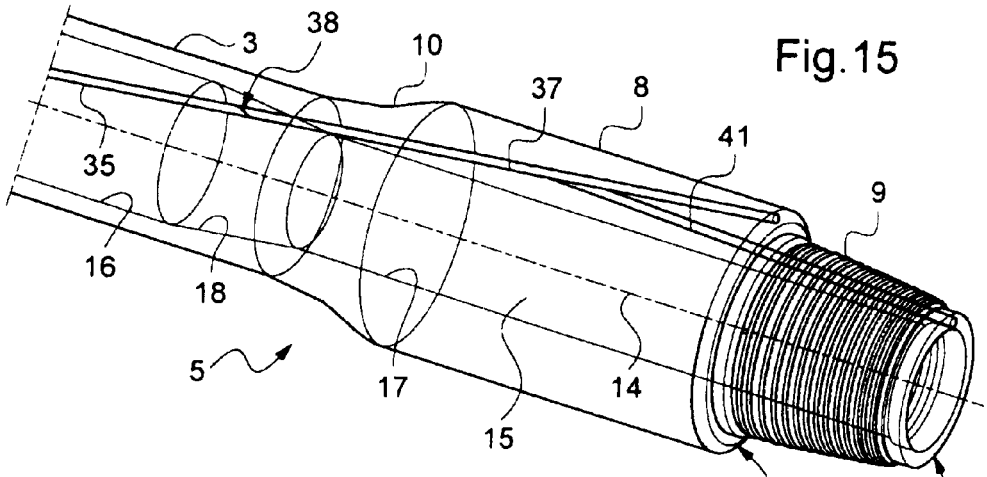
FIG. 15 is a perspective view similar to FIG. 14.

FIGS. 14 and 15 show a third variant of the first junction portion 5 of the elongate tube 2.

Here, the first junction portion 5 does not have a second peripheral recess 39.

The second hole 37 opens directly at the first bearing surface 19 of the first junction portion 5. The second diversionary hole 41 opens into the second hole 37.

In this variant the protective sheath 35 is introduced into the space defined by the longitudinal central bore from the first bearing surface 19, that is to say directly from the exterior of the elongate tube 2.

Figure 16:
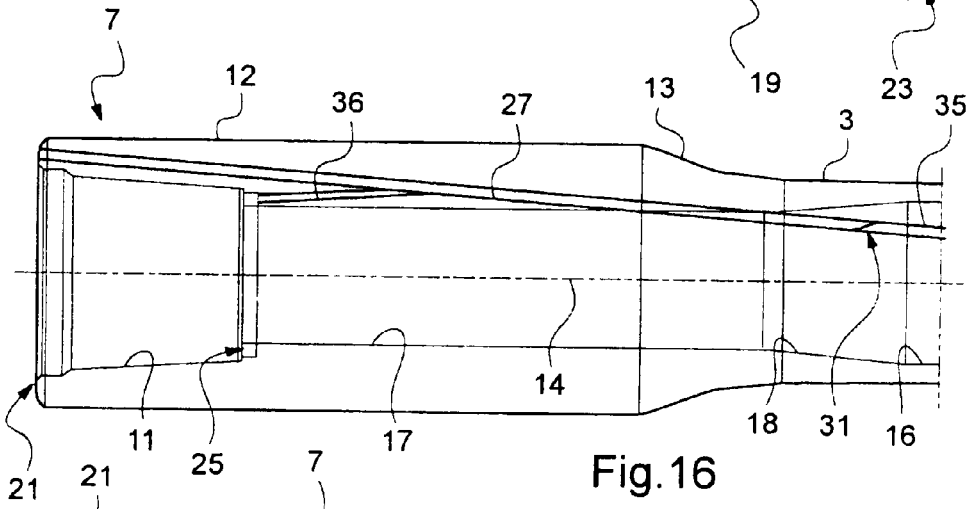
FIG. 16 is a front view of a first variant of the end portion of FIGS. 3 and 4.
Figure 17:
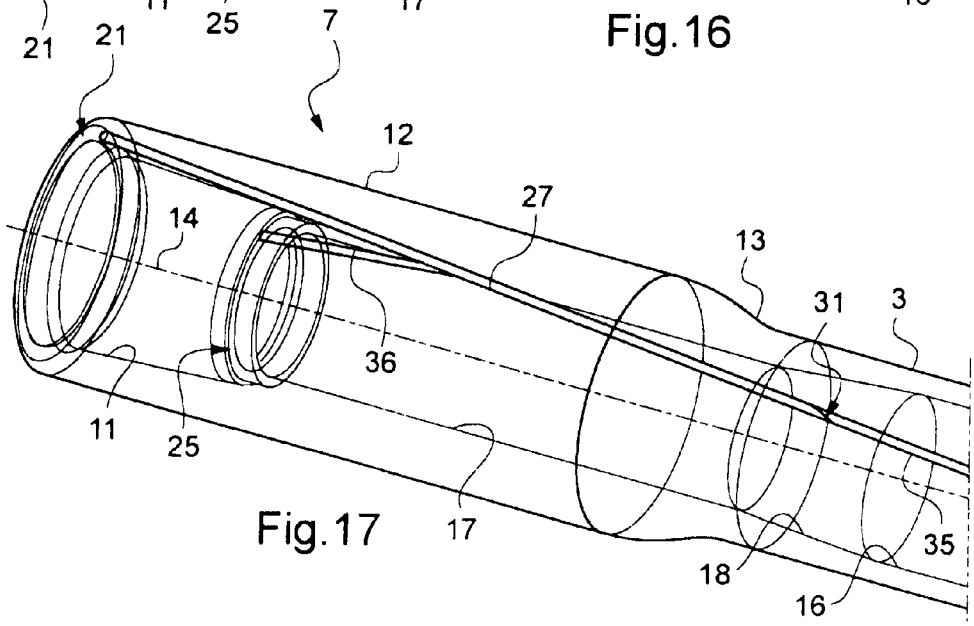
FIG. 17 is a perspective view similar to FIG. 16.

FIGS. 16 and 17 show a first variant of the second junction portion 7 of the elongate tube 2.

Here, the second junction portion 7 does not have a peripheral recess 32. The first hole 27 opens directly at the first bearing surface 21 of the second junction portion 7. The first diversionary hole 36 opens into the first hole 27.

The protective sheath 35 can be introduced from the first bearing face 21 of the second junction portion 7.

Figure 18:
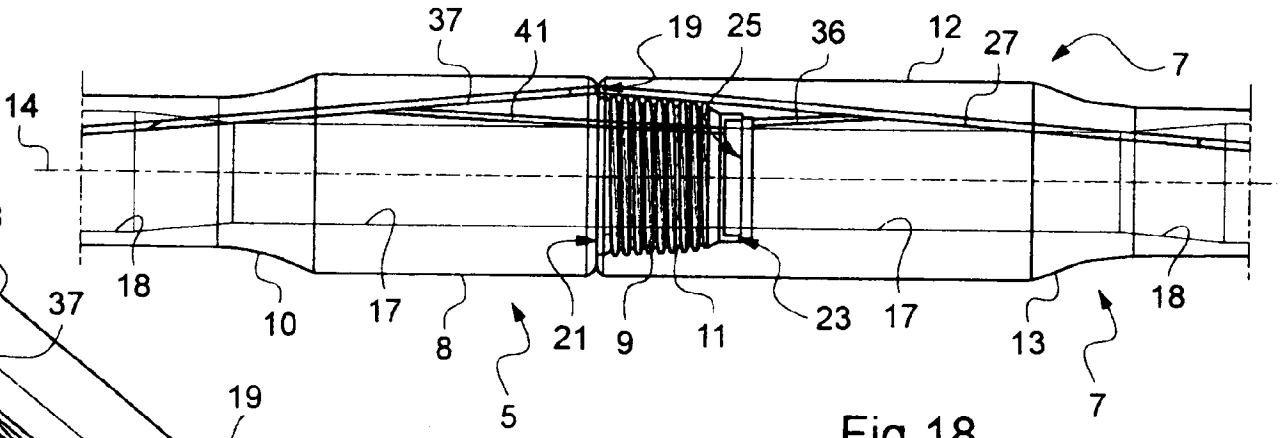
FIG. 18 is a front view of the end portion of FIGS. 14 and 15, connected to the end portion of FIGS. 16 and 17.
Figure 19:
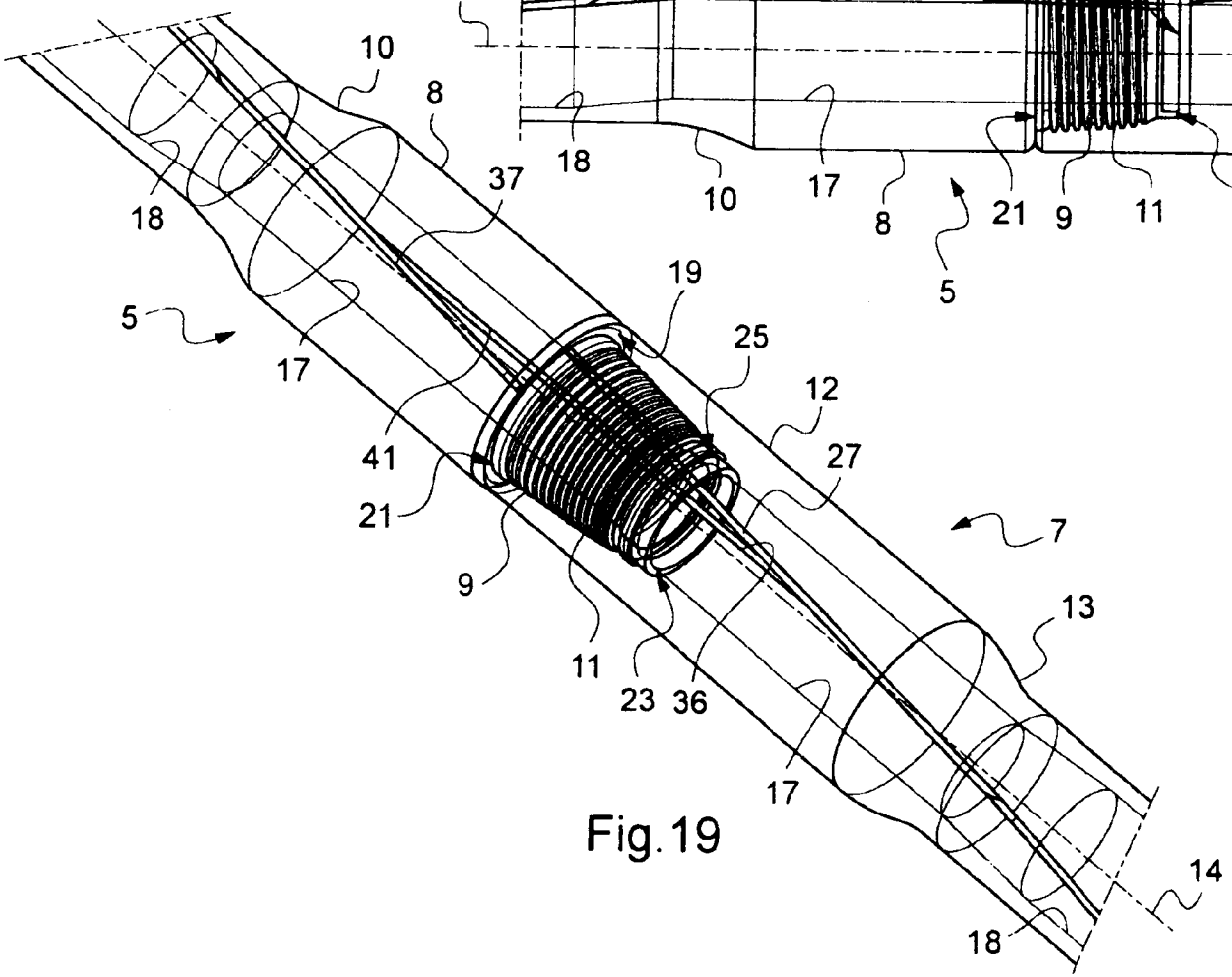
FIG. 19 is a perspective view similar to FIG. 18.

This variant can be used in combination with the first junction portion 5 in its third variant, as illustrated in FIGS. 18 and 19. This advantageous configuration of the elongate tube 2 is not obligatory.

The first diversionary hole 36 and the second diversionary hole 41 have been shown in such a way as to open in mutually facing relationship in FIGS. 18 and 19. That is a configuration that is entirely particular here and is in no way obligatory. In most applications, no fixed-wire element goes from one drill pipe 1 to the other, as explained hereinbefore. That does not exclude the possibility of the configuration of FIGS. 18 and 19 being an attractive proposition in highly particular applications.

The first hole 27 and the second hole 37 do not necessarily open in mutually facing relationship.

FIGS. 20 and 21 show a fourth variant of the first junction portion 5 of the elongate tube 2.

Here, the elongate tube 2 does not have a second recess 39 and a second diversionary hole 41.

The second hole 37 opens directly at the second bearing surface 23 of the first junction portion 5. In this variant which is of a particularly simple design configuration and is therefore economical, the protective sheath 35 can be introduced with a cable already housed in the interior thereof, connection to the transmission elements being subsequently implemented.

Figure 22:
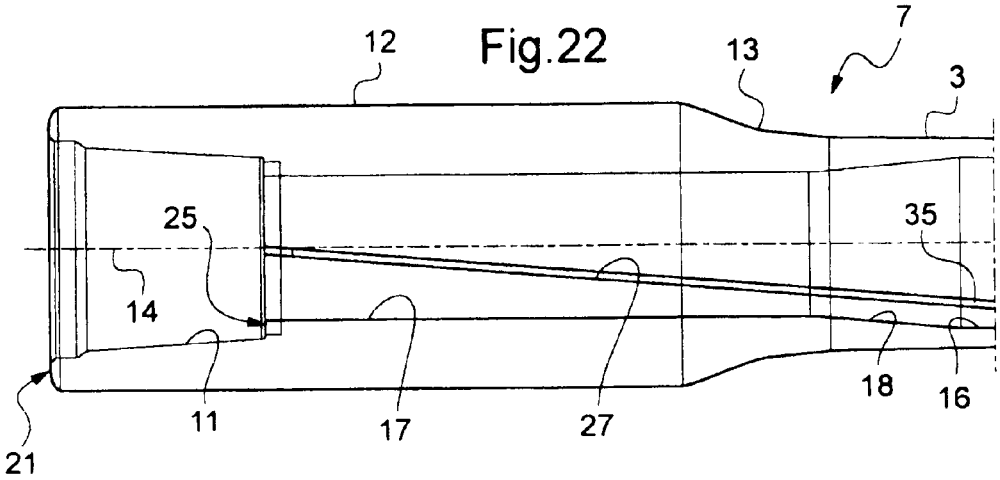
FIG. 22 is a front view of a second variant of the end portion of FIGS. 3 and 4.
Figure 23:
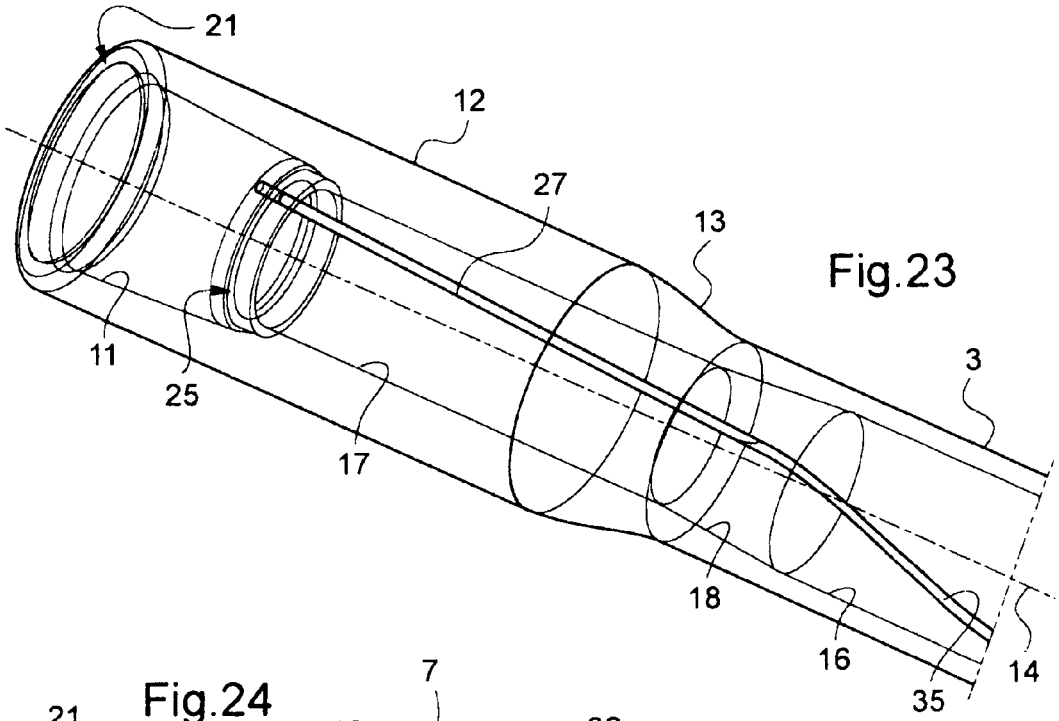
FIG. 23 is a perspective view similar to FIG. 22.

FIGS. 22 and 23 show a second variant of the second junction portion 7 of the elongate tube 2.

The elongate tube 2 here does not have a first peripheral recess 32 and a first diversionary hole 36. Introduction of the protective sheath 35 and connection of the cable elements that it protects can be effected in a similar manner to the fourth variant described hereinbefore.

Although that is not absolutely necessary, that second variant of the junction portion 7 is advantageously used in combination with the fourth variant of the first junction portion 5, in particular to simplify the machining ranges.

Thanks to the particular configuration of the first hole 27 the invention makes it possible to easily shape a protective sheath in a helical configuration and to cause said sheath to extend in a condition of bearing against the longitudinal central bore. In addition that configuration reduces the stress concentrations at the location of the junction between the part of the protective sheath that is accommodated in the first hole 27 and the part of that sheath extending in the longitudinal central bore 15.

In the embodiments described hereinbefore the first hole 27 and the second hole 37 accommodate a part of the protective sheath 35 which can be qualified as 'guided', in contrast to a 'free' part of that sheath, the free part extending between the first hole 27 and the second hole 37 in the longitudinal central bore 15. Partial guidance for the protective sheath 35 provides for a helicoidal configuration of the protective sheath 35, in particular in its free part.

For some highly particular applications, that free part could be held in its helicoidal shape in the longitudinal central bore 15, for example by means of a resin of epoxy type. In that particular embodiment also, the particular arrangement of the first hole 27 and the second hole 37 is advantageous.

The bias angle A2 has been defined in the plane P2 tangential to the longitudinal central bore 15 at the first intersection location 31. The invention could be defined in an equivalent manner with a bias angle A3 defined in a plane perpendicular to the central plane P1 and containing that first location 31. In that case the bias angle A3 is equivalent to the projection of the bias angle A2 into that plane perpendicular to the central plane P1.

The invention is not limited to the embodiments described herein solely by way of example but embraces all the variants that the man skilled in the art can envisage.

In particular:

One or other of the first hole 27 and the second hole 37, in addition to the straight segment described hereinbefore, may have segments of any shape, connecting the straight segment to the exterior of the elongate tube 2.

The elongate tube 2 may have a plurality of holes of the same type as the first hole 27, for example in the situation where a plurality of protective sheaths are to extend against the longitudinal central bore 15.

The first hole 27 or the second hole 37 could open directly at the exterior surface of the elongate tube 2, in particular in accordance with the connections to be made with the cables introduced in the protective sheath 35.

The elongate tube 2 may have a curved central line.

The first hole 27 or the first hole 37 could open at a different portion of the longitudinal central bore 15, for example directly at the central portion 16.

The elongate tube 2 may have solely the first hole 27, or again the second hole 37 may be arranged differently from the first hole 27, in terms of the value of the first angle A1 and the second angle A2.

The first junction portion 5 and the second junction portion 7 can be adapted to the connection to drill strings of different configurations and can be arranged in non-complementary relationship.

The first diversionary hole 36 or the second diversionary hole 41 may open elsewhere than at the second bearing surfaces 23 and 25, in particular at the first bearing surfaces 19 and 21, in particular when elements to be electrically connected are disposed in the proximity of those latter surfaces.

The first and second holes 27 can be extended beyond the thickness of the drill pipe 1, for example in the situation where the central bore would have a protective coating layer which in particular is fairly thick.

The invention is applied to all types of drill pipes, including the pipes which are referred to as heavy pipes and drill collars.

The invention also embraces a drill string afforded by connecting drill pipes 1 in butting relationship. That butting relationship comprises placing the drill pipes 1 in end-to-end butting relationship and clamping them together.

The invention claimed is:

1. A drill string element comprising:

an elongate tubular body delimiting an interior surface longitudinally including at least one portion of revolution and a first hole provided in the elongate tubular body, the first hole including a first end opening at the portion of revolution, the first hole including in a vicinity of the first end a longitudinal axis intersecting the interior surface at an intersection location, wherein the longitudinal axis, in projection into a first plane passing through the central axis of the portion of revolution and containing the intersection location, forms a first angle of a value that is not zero and in projection into a second plane tangential to an interior surface at the intersection location forms a second angle of a value that is not zero, wherein the second plane is perpendicular to the first plane.

2. An element according to claim 1, wherein the elongate tubular body includes at least one of its longitudinal ends a junction portion configured to cooperate with another drill string element and including a substantially transversely disposed bearing surface, and wherein an element at least of the group formed by the first hole and a first supplementary hole opens at the bearing surface.

3. An element according to claim 2, wherein the first hole opens in a peripheral recess of the elongate tubular body, which is open outwardly.

4. An element according to claim 3, wherein the first supplementary hole opens into the peripheral recess.

5. An element according to claim 2, wherein the first supplementary hole opens at the bearing surface and in the first hole.

6. An element according to claim 2, wherein the junction portion further includes a substantially transversely disposed supplementary bearing surface, and wherein an other element of the group opens at the supplementary bearing surface.

7. An element according to claim 2, wherein the bearing surface is arranged at a free end of a junction portion of male type or in a form of an interior shoulder of a junction portion of female type.

8. An element according to claim 7, wherein a supplementary bearing surface is arranged in a form of an intermediate shoulder of the junction portion of male type or at a free end of the junction portion of female type.

9. An element according to claim 1, wherein the elongate tubular body includes a second hole with a first end opening at the interior surface, the second hole including in a vicinity of first end a longitudinal axis intersecting the interior surface at a second location.

10. An element according to claim 9, wherein a value of the second angle is selected in dependence on a longitudinal distance separating the intersection location from the second location.

11. An element according to claim 9, wherein the interior surface includes at least one straight cylinder portion between the intersection location and the second location.

12. An element according to claim 11, wherein the straight cylinder portion extends substantially over the longitudinal distance separating the interesection location from the second location.

13. An element according to claim 9, wherein the second hole opens in a second portion of revolution, and wherein the longitudinal axis of the second hole, in projection into a third plane passing through the central axis of the second portion of revolution and containing the second location, forms a third angle of a value that is not zero and, in projection into a fourth plane tangential to the interior surface at said second location, forms a fourth angle of a value that is not zero.

14. An element according to claim 13, wherein a value of the fourth angle is close to the value of the second angle.

15. An element according to claim 1, wherein the first hole extends over practically a whole of its length in rectilinear relationship.

16. An element according to claim 1, further comprising a flexible tubular element at least partially accommodated in the hole and extending over the interior surface while generally describing a helix.

17. An element according to claim 16, wherein the helix involves an angle dependent on the value of the second angle.

18. An element according to claim 1, further comprising an electrical connecting device accommodated in a wall thickness of the elongate tubular body.

19. An element according to claim 1, wherein a value of the second angle is between 5° and 40°.

20. A drill string formed by connection in butting relationship of elements according to claim 1.

21. A drill string element comprising:

an elongate tubular body with a central bore, a hole extending through a portion of the elongate tubular body, and opening into the central bore such that a longitudinal axis of the first hole intersects the central bore at an intersection location in a vicinity of the first end of the first hole, extends at a non-zero penetration angle relative to a first plane passing through a central axis of the portion of the elongate tubular body and containing the intersection location, and extends at a non-zero bias angle relative to a second plane perpendicular to the first plane and containing the intersection location.

22. A drill string element comprising:

an elongate tubular body delimiting an interior surface longitudinally including at least one portion of revolution and a first hole provided in the elongate tubular body, the first hole including a first end opening at the portion of revolution, the first hole including in a vicinity of the first end a longitudinal axis intersecting the interior surface at an intersection location, and a flexible tubular element at least partially accommodated in the hole and extending over the interior surface while generally describing a helix, wherein the longitudinal axis, in projection into a first plane passing through the central axis of the portion of revolution and containing the intersection location, forms a first angle of a value that is not zero and in projection into a second plane tangential to an interior surface at the intersection location forms a second angle of a value that is not zero, and wherein the helix involves an angle dependent on the value of the second angle.

23. A drill string element comprising:

an elongate tubular body delimiting an interior surface longitudinally including at least one portion of revolution and a first hole provided in the elongate tubular body, the first hole including a first end opening at the portion of revolution, the first hole including in a vicinity of the first end a longitudinal axis intersecting the interior surface at an intersection location, and the elongate tubular body including at at least one of its longitudinal ends a junction portion configured to cooperate with another drill string element and including a substantially transversely disposed bearing surface, wherein the longitudinal axis, in projection into a first plane passing through the central axis of the portion of revolution and containing the intersection location, forms a first angle of a value that is not zero and in projection into a second plane tangential to an interior surface at the intersection location forms a second angle of a value that is not zero, wherein an element at least of the group formed by the first hole and a first supplementary hole opens at the bearing surface, and wherein the junction portion further includes a substantially transversely disposed supplementary bearing surface, and another element of the group formed by the first hole and a first supplementary hole opens at the supplementary bearing surface.

* * * * *